United States Patent [19]

Post et al.

[11] Patent Number: 4,683,799

[45] Date of Patent: Aug. 4, 1987

[54] ARRANGEMENT FOR RAPIDLY STOPPING AN AUTOMATIC WEAPON HAVING AN EXTERNAL DRIVE

[75] Inventors: Lothar Post, Dusseldorf; Bernhard Schneider, Niederkrüchten, both of Fed. Rep. of Germany

[73] Assignee: Rheinmetall GmbH, Dusseldorf, Fed. Rep. of Germany

[21] Appl. No.: 729,996

[22] Filed: May 3, 1985

Related U.S. Application Data

[63] Continuation-in-part of Ser. No. 584,802, Feb. 29, 1984, abandoned.

[30] Foreign Application Priority Data

Mar. 5, 1983 [DE] Fed. Rep. of Germany ..... 3307882

[51] Int. Cl.[4] ..... F41D 7/02; F41D 11/00

[52] U.S. Cl. ..... 89/11

[58] Field of Search ..... 89/9, 11, 12–14

[56] References Cited

U.S. PATENT DOCUMENTS

| | | | |
|---|---|---|---|
| 2,630,741 | 3/1953 | Robert et al. | 89/1.51 X |
| 4,131,052 | 12/1978 | Skahill | 89/11 |
| 4,154,143 | 5/1979 | Pechamat et al. | 89/11 |
| 4,193,335 | 3/1980 | Tassie | 89/11 X |
| 4,301,709 | 11/1981 | Bohorguez et al. | 89/11 |

*Primary Examiner*—David H. Brown

[57] ABSTRACT

This invention relates to an arrangement for rapidly stopping an automatic weapon having an external drive where the breech block is driven by parallel shafts. This arrangement provides for the rapid stopping of the shafts and thus the weapon by providing the shafts with coaxially mounted pockets at their ends in which a pair of claws may be engaged to stop the rotation of the shafts.

5 Claims, 5 Drawing Figures

ARRANGEMENT FOR RAPIDLY STOPPING AN AUTOMATIC WEAPON HAVING AN EXTERNAL DRIVE

This application is a continuation-in-part of application Ser. No. 584,802, filed Feb. 29, 1984, now abandoned.

BACKGROUND OF THE INVENTION

The invention relates to an arrangement for rapidly stopping an automatic weapon having an external drive.

Self-driven weapons receive the driving energy for their operative cycle (unlocking, locking and moving the breech block) from the energy which is released by the propellant charge at firing. In contradistinction thereto, automatic weapons which are driven by an external drive use an external source of energy, for example an electric motor.

In case of malfunctioning, such as hangfire (non-ignition or delayed ignition), the breech block of a self-driven weapon remains in the locked condition so that the weapon itself or the personnel manning the weapon are not endangered. In contradistinction thereto, in an automatic weapon having an external drive an automatic safety is not always available in view of the fact that the external drive precisely controls the opening of the breech block even when no energy is supplied by the propellant charge. Therefore it is necessary to provide additional safety features in automatic weapons with external drive in order to use the advantages flowing from the use of such weapons.

There is described in U.S. Pat. No. 4,154,143 an automatic weapon with external drive which uses at least one locking bolt for locking the breech mechanism in the advanced position with respect to the breech casing. This breech bolt is urged elastically towards the trajectory of the breech mechanism.

SUMMARY OF THE INVENTION

It is a general object of the invention to provide an arrangement for rapidly stopping an automatic weapon having an external drive which has a simplified construction and is therefore more reliable than the known arrangements of the aforedescribed type.

It is another object of the invention to provide such an arrangement for rapidly stopping an automatic weapon having an external drive which can, in case of hangfire of an automatic weapon having a high firing cadence and larger caliber, reliably move the weapon into a safety position.

BRIEF DESCRIPTION OF THE DRAWINGS

The invention will be further explained in greater detail below with reference to the accompanying drawing which illustrate a preferred embodiment of it.

DETAILED DESCRIPTION

Figure 1:
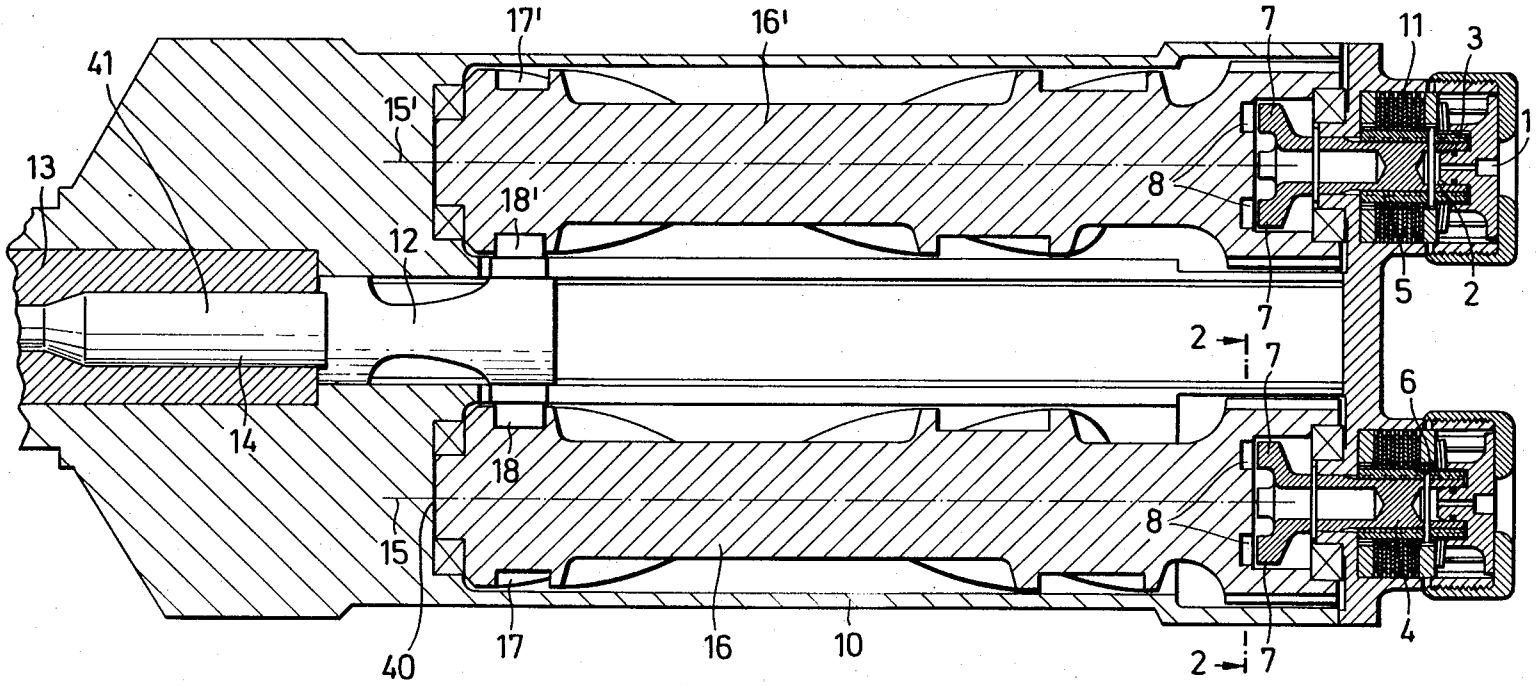
FIG. 1 is a longitudinal sectional view through the automatic weapon in the region of the breech casing.

FIG. 1 illustrates in longitudinal section a portion of the weapon in the region of the breech housing 10 where the gun barrel 13 is connected thereto. A breech block 12 is reciprocally movably mounted in the breech housing 10. This breech block 12 closes in its forward position (see FIG. 1) the cartridge chamber 14 of the gun barrel 13. There are bilaterally mounted relative to the breech block 12 in the breech casing 10 a pair of first shafts 16, 16' which are parallelly disposed with respect to each other and with their axes of rotation 15, 15' parallel relative to the path of the breech block. These first shafts 16, 16' are rotated by external drive means, for example an electric or a hydraulic-motor 47. The first shafts 16, 16' coaxially support a pair of annular or box cams 17, 17'. A pair of cam followers 18,18' engage in the annular cams 17, 17' to provide a driving engagement for the breech block 12 so that the rotary movement of the first shafts 16, 16' is converted into a forced reciprocatory movement of the breech block 12.

Figure 3:
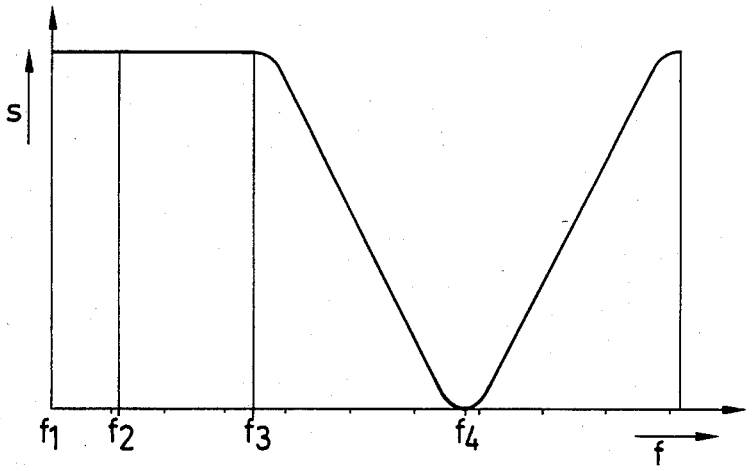
FIG. 3 is a diagram of the breech block travel as a function of the angle f of rotation of a breech block driving shaft.

Turning now to FIG. 3, the movements of the breech block 12 in dependence upon the angle of rotation of of the first shafts 16, 16' is depicted in conjunction with the diagram of FIG. 3. The breech block 12 does not move during the time interval $f_1$–$f_3$ but is retained in its forward-most (upper in FIG. 3) position so as to close cartridge chamber 14. This manner of operation is determined by the configuration of the annular cams 17, 17' which have no slope or virtually no slope in the region corresponding to $f_1$–$f_3$. At the start of angle $f_3$ the breech block 12 begins to move towards its rearmost (open) position which is reached upon rotation of the cams to angle $f_4$. At this point the movement of the breech block is braked and the direction of its movement is reversed so that it runs again forwardly to close the cartridge chamber 14 again for a limited period of time for the next operative cycle.

The description of the feed path of the cartridges for the aforedescribed arrangement has deliberately been omitted since such description is not necessary for an understanding of the invention.

There is present a rigid locking or partial unblocking of the breech block 12 during the normal time interval $f_1$–$f_3$. The cartridge disposed in the cartridge chamber 14 is ignited, the gas pressure builds up, the projectile leaves the muzzle of the gun barrel and the gas pressure drops again. In order for the unblocking of the breech block not to occur upon malfunctioning of the weapon, that is, during misfiring or delayed firing of the weapon, the automatic weapon must remain inoperative beyond the time interval $f_1$–$f_3$, that is beyond the normal time interval that the breech block 12 is rigidly locked or blocked. It is definitely not adequate simply to switch off the external drive in order to ensure with complete safety a complete deactivation of the automatic weapon in view of the fact that there remains sufficient kinetic energy in the system of the weapon to move the breech block 12 in an impermissible way out of the locked or blocked position when and how the external source of power is terminated, should firing delay or failure occur ("hang-fire"), is not of importance to the presently claimed invention but is known and solved in the state of the art. Again see U.S. Pat. No. 4,154,143, column 7, lines 30–33 and lines 45–54; column 9, lines 14–20; and, in particular, column 10, lines 14–19 in connection with the drawings FIG. 9 and 11 (switch 73).

The invention provides for a safe deactivation and thereby a secure locking or fixing of the breech block by locking the first shafts 16, 16'. This locking is effected by the blow-like engagement of a pair of claws 7 each claw having a pair of diametrically opposite pins (see FIGS. 1 and 2) which engage into mating pockets 8, disposed in the end faces of the respective first shafts 16, 16' which confront the claws 7. The claws 7 form extensions of or are mounted on second claw shafts 4 on which there also coaxially rigidly mounted a plurality of clutch discs of clutch 11. The first shafts 16, 16' whose rotations are restrained by the engagement of the claws 7 into the pockets 8, tend to impart a rotary movement to the second shafts 4, which movements are, however, prevented by the frictional forces occurring in the clutches 11.

The blow-like engagement of the claws 7 into the pockets 8 of the first shafts 16, 16', which is required for the immediate arresting of the automatic weapon, is achieved by means of a pyrotechnical ignition charges 1 (FIG. 1). Each of ignition charges 1 is mounted in a member 1*a* forming a rear extension of the claw shaft 4. After ignition of the pyrotechnical ignition charges 1 there first builds up a gas pressure in each of the pressure chambers 2, which is sealed by means of an O-ring 3 towards the rear. This gas pressure exerts a force onto the claw shaft 4 and moves the same in the direction towards the end faces (bottoms) of the pockets 8 in the shafts 16, 16'. The second claw shafts 4 are, for this purpose, axially movably mounted by means of splined toothings 5 relative to the clutch 11. The axial movement of the second claw shafts 4 results immediately after shearing off of shear pins 6, which when in an undisturbed operative condition secure the claw shafts in a non-rotating position. After engagement of the claws 7 into the pockets 8 the disc clutch 11 brakes the rotation of the second claw shafts 4 thereby effecting in an impact-less manner a standstill of the entire system including a standstill of the first shafts 16, 16' within the interval $f_2$ to $f_3$.

The time interval for the rigid locking of the breech block 12 is particularly short in those automatic weapons having a high firing cadence. In order to achieve an arresting of the system in such an automatic weapon the claws 7 must be moved axially into the pockets 8 of the first shafts 16, 16' within a time interval of no more than 2 to 3 milliseconds. The axial driving of the second claw shafts 4 by means of pyrotechnical charges 1, in accordance with the invention, guarantees this extremely short engagement time interval with maximum operative safety and minimum constructional complexity.

Once the source of malfunction is removed, the weapon can again be placed in an operative condition by replacing the shear pins 6 and the pyrotechnical charges 1, which can be carried out in a short period of time.

Figure 2:
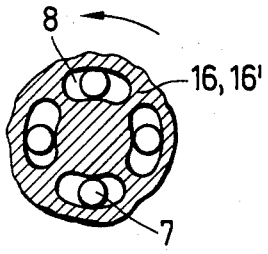
FIG. 2 is a cross-sectional view through a portion of the breech casing along line 2—2 of FIG. 1.

FIG. 2 illustrates by means of a cross-section through a portion of the breech housing 10 along line 2—2 of FIG. 1 the engagement of the claws 7 into the pockets 8.

Figure 1A:
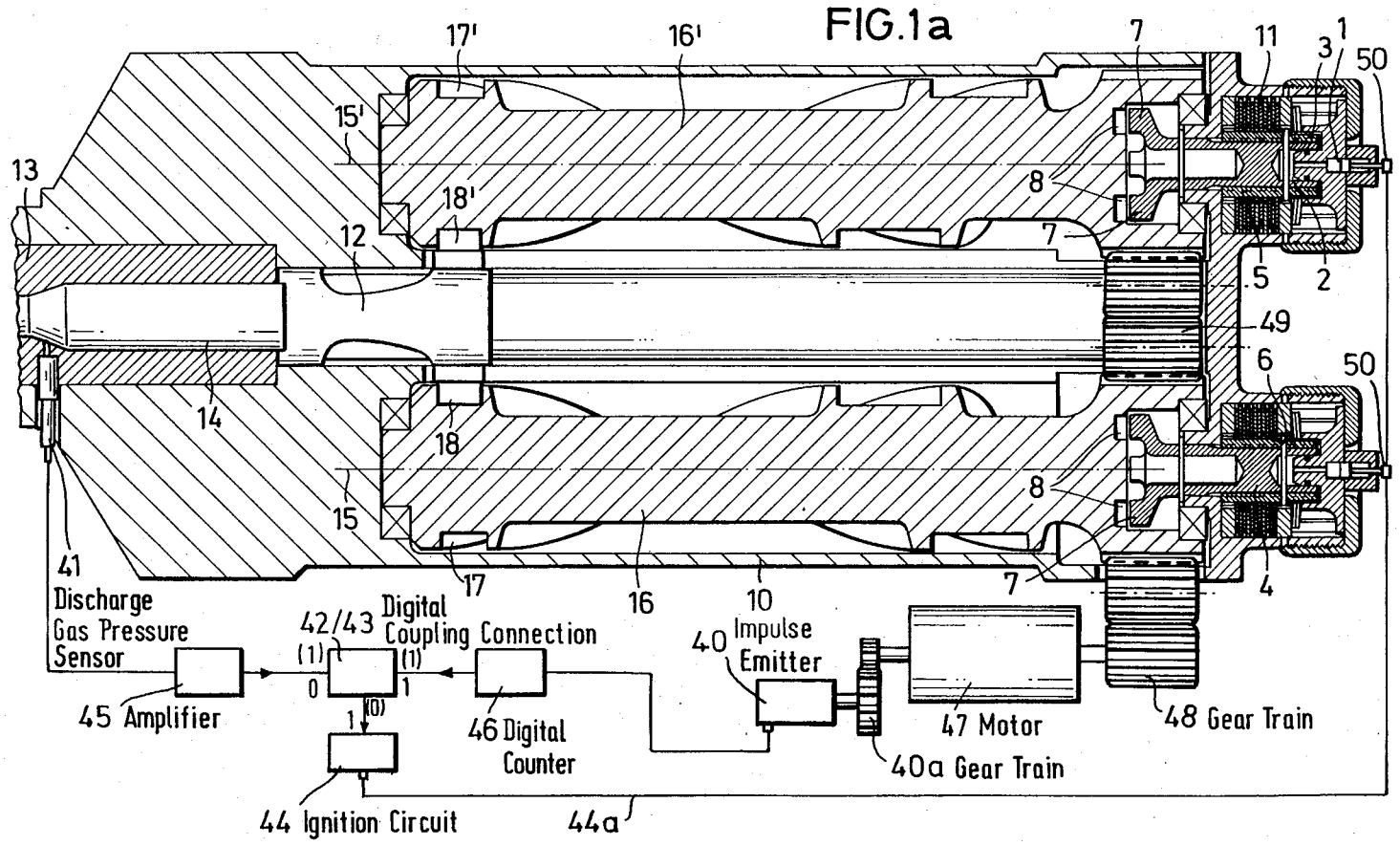
FIG. 1*a* is a view in section through the automatic weapon as in FIG. 1, but with the addition thereto of a schematic diagram of the mechanism for the rapid stopping of the firing of the weapon.
Figure 4:
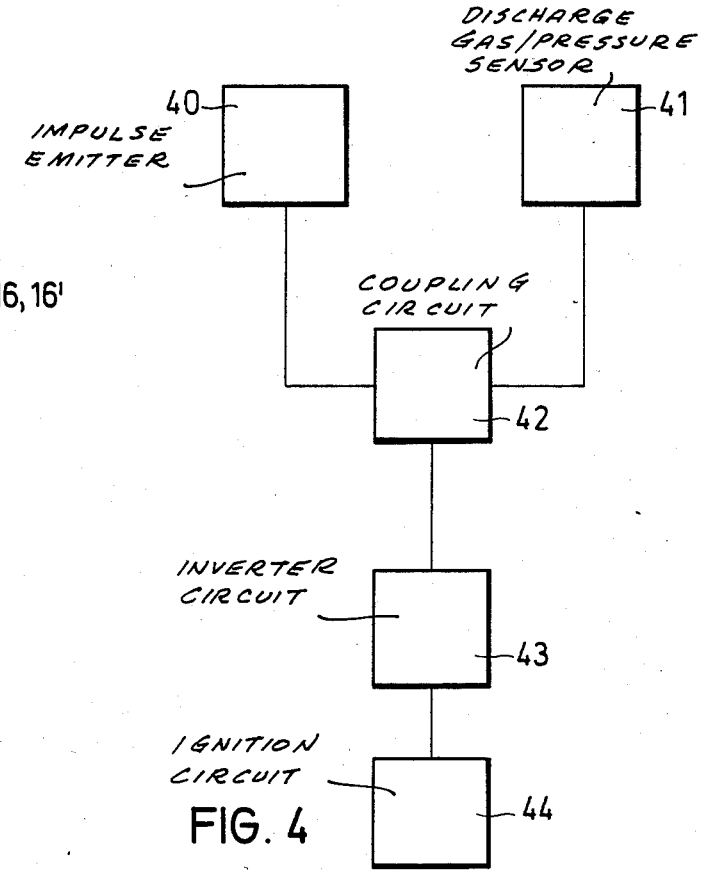
FIG. 4 is a block diagram for illustrating the signal pulse path.

The actuation of the charges 1 is explained in conjunction with FIG. 1*a* and the thereto pertaining block diagram of FIG. 4, which schematically illustrates the path of the signal which leads to the release of the charges 1.

The shafts 16, 16' are driven by an exterior source of energy, for example an electric motor or a hydraulic motor 47 via an intermediate switching of an intermediate gear train 48, respectively 49. An impulse emitter 40 is also coupled in a further gear train 40*a*, which during its rotation pulses, for example, 360 pulses for a full rotation of 360 degrees. The electromagnetic impulse emitter is advantageously of the type GEM 93 of the firm TWK Elektronik, Duesseldorf. The electrical signals which are produced by the electromagnetic impulse emitter, which are then conducted to a digital coupling connection 42. This coupling connection 42 is for example an And-member which emits only an output signal, when a signal is fed to both inputs thereof. To one of its inputs there is conducted the output pulses of the electromagnetic pulse emitter 40 via the digital counter 46, which indicate the rotational movement of the shafts 16, and 16' which are coupled to the motor 47 via the intermediate gear drives 48 and 49.

In a bore of the gun barrel 13 a pressure sensor 41 is arranged; this determines whether after a regularly carried out firing process the expected gas pressure development that occurs under normal circumstances is taking place. There is advantageously used as the sensor 41 a piezo electric element, for example a quartz element, an acceleration regulator, a bridge made out of an expandable measuring strip or simply a mechanical scanner. A pressure measuring quartz of the type 6203 of the Swiss firm Kistler has been found to be particularly advantageous for this purpose. The sensor 41 is connected to an amplifier 45, which amplifies the voltage put out by the quartz 41 and conducts it to the second input of the And-member 42 and/or post-coupled to it, which effects a single inversion and thereby prevents during the normal operation that the ignition circuit 44 conducts via the conduit 44*a* an activating pulse to the charges 1. During normal operation the following signals are applied to the And-circuit and the thereto connected inverter circuit 43. First, an output signal from the electromagnetic impulse emitter, which indicates that the motor 47 and the thereto connected shafts 16, 16' rotate, which again indicates, that the breech 12 operates properly. Further, there is applied to the coupling circuit 42 the electric signal that is emitted from the pressure quarts 41 as a result of the applied pressure, which indicates, that after a normal firing of a cartridge disposed in the cartridge chamber 14 the expected gas pressure increase has occurred. The inverter circuit 43 serves in this case for the purpose that no signal transmitted further by the ignition circuit 44 and that the ignition charge 1 is not released via the contact 50.

In case of malfunctioning the signals emitted by the electromagnetic pulse emitter are inputed at the coupling circuit 42, and indicate, that the motor 47 and the shafts 16, 16' rotate.

Since the cartridge disposed in the cartridge chamber has malfunctioned and thereby no pressure increase has occurred, the pressure sensor 41 does not emit a signal, so that at the second input of the And-circuit 42 there also is not imputed a signal.

The inverter circuit 43 serves now for the purpose that the ignition circuit 44 has inputed thereon an output signal, and switches on via the conduit 44*a*, the contacts 50 for actuating the ignition charges 1.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

Although the invention is described and illustrated with reference to a limited number of embodiments thereof, it is to be expressly understood that it is in no way limited to the disclosure of such preferred embodiments but is capable of numerous modifications within the scope of the appended claims.

We claim:

1. An arrangement for rapidly stopping an automatic weapon having an external drive, and wherein the gun barrel is connected to the breech housing, said arrangement comprising a cartridge chamber within said breech housing, a lockable breech block reciprocally movably mounted in the breech housing, and means for effecting the reciprocal movement of the breech block comprising at least on first shaft or a pair of first shafts bilaterally mounted relative to the breech block in the breech casing and parallelly disposed with respect to each other with their axes of rotation parallel relative to the path of the breech block, said first shaft being rotatable by external drive means, each first shaft coaxially supporting an annular cam, each cam engaging a cam follower, each cam follower being operatively connected to the breech block such that a rotary movement of the first shaft effects a reciprocal movement of the breech block; and means for rigidly locking the first shaft against rotational movement, wherein said means comprises a plurality of coaxially disposed pockets in the end of each first shaft, a respective second claw shaft having claws on the end thereof confronting the pockets in the end of each first shaft, and a plurality of clutch discs coaxially mounted on each second claw shaft, and means comprising pyrotechnical ignition charges mounted in respective members forming rear extension of each claw shaft.

2. An arrangement according to claim 1, wherein the plurality of clutch discs are coaxially mounted on each second claw shaft by means of splined toothings.

3. An arrangement according to claim 2, wherein each of the claw shafts is secured in a non-rotating position by means of a shear pin.

4. An arrangement according to claim 3, wherein each of the members forming rear extensions of each claw shaft and sealed from the claw shaft by means of an O-ring.

5. An arrangement according to claim 4, further comprising a first sensor which senses the rotational movement of the shafts, a second sensor which senses the presence of gas pressure built up in the cartridge chamber, a coupling circuit which combines the outputs of the first and second sensors, and means for igniting the pyrotechnical ignition charge according to the output of the coupling circuit.

* * * * *